US005504950A

United States Patent [19]

Natalizia et al.

[11] Patent Number: 5,504,950

[45] Date of Patent: Apr. 9, 1996

[54] VARIABLE TEMPERATURE ELECTRONIC WATER SUPPLY SYSTEM

[75] Inventors: Mark L. Natalizia, Rialto; Tan T. Pham, Glendale, both of Calif.

[73] Assignee: Adams Rite Sabre International, Glendale, Calif.

[21] Appl. No.: 271,509

[22] Filed: Jul. 7, 1994

[51] Int. Cl.[6] ..... E03C 1/05

[52] U.S. Cl. ..... 4/623; 137/625.41; 251/129.11

[58] Field of Search ..... 4/623; 137/102, 137/625.41; 251/129.04, 129.11, 129.12, 207

[56] References Cited

U.S. PATENT DOCUMENTS

| | | | |
|---|---|---|---|
| 3,115,896 | 12/1963 | Roberts et al. | 137/625.41 |
| 3,480,787 | 11/1969 | Johansen | 4/623 X |
| 4,178,963 | 12/1979 | Riefler et al. | 137/625.41 X |
| 4,391,265 | 7/1983 | Chen | 251/207 X |
| 4,523,604 | 6/1985 | Hutto | 137/102 |
| 4,643,215 | 2/1987 | Phlipot et al. | 251/207 X |
| 4,673,160 | 6/1987 | Tolley | 251/129.11 X |
| 4,682,628 | 7/1987 | Hill | 4/623 X |
| 4,894,874 | 1/1990 | Wilson | 4/623 |
| 4,955,535 | 9/1990 | Tsutsui et al. | 4/623 X |

FOREIGN PATENT DOCUMENTS

| | | | |
|---|---|---|---|
| 9400645 | 1/1994 | WIPO | 4/623 |

OTHER PUBLICATIONS

Copy of engineering drawings of Adams Rite Sabre International Faucet Part No. 9776, 2 pgs., no date given.

*Primary Examiner*—Robert M. Fetsuga

*Attorney, Agent, or Firm*—Knobbe, Martens, Olson & Bear

[57] ABSTRACT

A variable temperature electronic faucet water supply system provides a plurality of preset water temperature settings from which the user may select a desired water temperature by pressing a temperature selection button. If no water temperature is selected by the user, the faucet automatically delivers water at a default temperature setting. The faucet water supply system includes a motion detector mounted in the head of the faucet which will detect motion near the faucet head. The water is delivered from the faucet head at the preselected temperature when motion is detected near the faucet head. Water is delivered at the preselected temperature for up to two seconds after motion is last detected near the faucet.

4 Claims, 13 Drawing Sheets

START (POWER ON RESET)
425
INITIALIZE SYSTEM
426
WATCHDOG ERROR SET ?
YES
427
LOCK SYSTEM INTO LOOP
NO
428
IR MOTION DETECTED ?
YES
432
TURN WATER ON
NO
429
WATER TURN-OFF DELAY DONE ?
YES
431
TURN OFF WATER
NO
433
DECREMENT TURN-OFF COUNTER
430
TEMP. TIMEOUT DONE ?
YES
NO
434
DECREMENT TEMP. TIME OUT PERIOD
436
WATER WATCHDOG DONE ?
YES
440
SET WATCHDOG ERROR
NO

VARIABLE TEMPERATURE ELECTRONIC WATER SUPPLY SYSTEM

FIELD OF THE INVENTION

This invention relates to plumbing systems and particularly to sink water controls especially adapted for use in aircraft restrooms.

BACKGROUND OF THE INVENTION

Because of the millions of people using public restrooms, it is important that simple, easy-to-use facilities be available. This has become increasingly more important in the United States, since the passage of the Disabled Persons Act. Many disabled people can not operate the knobs, plungers, etc. which are commonly used sink fixtures. It would be desirable to provide a sink control system that is easy for all people to use, disabled or not.

Currently, some restrooms utilize proximity sensors to turn on and off the sink water supply and thereby eliminate water control knobs. The proximity sensor turns on the water when an object is placed near the water outlet of the faucet. However, without knobs, the user cannot select the temperature of the water that is supplied by the proximity sensing faucets. In many instances, it would be desirable for the user to select from a variety of water temperatures for different types of applications. The inability to enable the selection of the desired water temperature is a major drawback to the widespread use of these proximity sensing faucets.

The restrooms provided on airplanes are extremely small. Consequently, it would be desirable to remove all unneeded knobs, buttons, plungers, etc., that are commonly used to operate a faucet, in order to make more counter space available for airline passengers. However, it would be desirable to provide the total functionality of a traditional faucet to faucet system for an airplane restroom while minimizing the amount of space it requires.

Therefore, it would be desirable to have sink water controls that are easy to operate and do not require bulky conventional components to provide water delivery at variable temperatures.

SUMMARY OF THE INVENTION

The aforementioned goals are satisfied by a variable temperature electronic water supply system of the present invention. The system provides a plurality of preset water temperature settings from which the user may select a desired water temperature by operating a temperature selection element. If no water temperature is selected by the user, the faucet automatically delivers water at a default temperature setting. The system preferably includes a motion detector mounted in the faucet, which will detect motion beneath the faucet outlet. The water is delivered from a faucet outlet at the preselected temperature when motion is detected near the faucet head. In one embodiment, water is delivered at the preselected temperature for up to two seconds after motion is last detected near the faucet. In addition, to prevent water waste, the delivery of water from the faucet ceases after a pre-selected period of constant water flow from the faucet.

In a preferred arrangement the temperature settings are selected by depressing one of a series of membrane switches that are conveniently positioned directly on an upper surface of the faucet. Also positioned on that surface is a switch to energize a solenoid controlled sink drain valve.

The system includes a hydraulic block assembly having hot and cold water inlets leading to a mixing chamber. A rotary valve in the chamber determines the proportion of hot and cold water admitted to the chamber. The valve is preferably positioned by a stepper motor. A signal from the selected temperature switch is transmitted to an electronic control which provides a signal to the stepper motor that moves the mixing chamber valve to obtain the desired water temperature mix. A signal from the motion detector to the electronic control produces a signal to operate a solenoid valve to deliver water of the selected temperature to the faucet. A signal from the drain switch to the electronic control produces a signal to the solenoid drain valve to drain sink water.

Advantageously, the faucet assembly can be made as a separate module so that can be replaced by another faucet module by disconnecting and reconnecting the water and electrical connections. Likewise the hydraulic block and the electronic control may be made as separate modules for ease of installation and repair.

These and other features and advantages of the present invention are set forth more completely in the accompanying drawings and the following description.

DETAILED DESCRIPTION OF THE PREFERRED EMBODIMENTS

Figure 1:
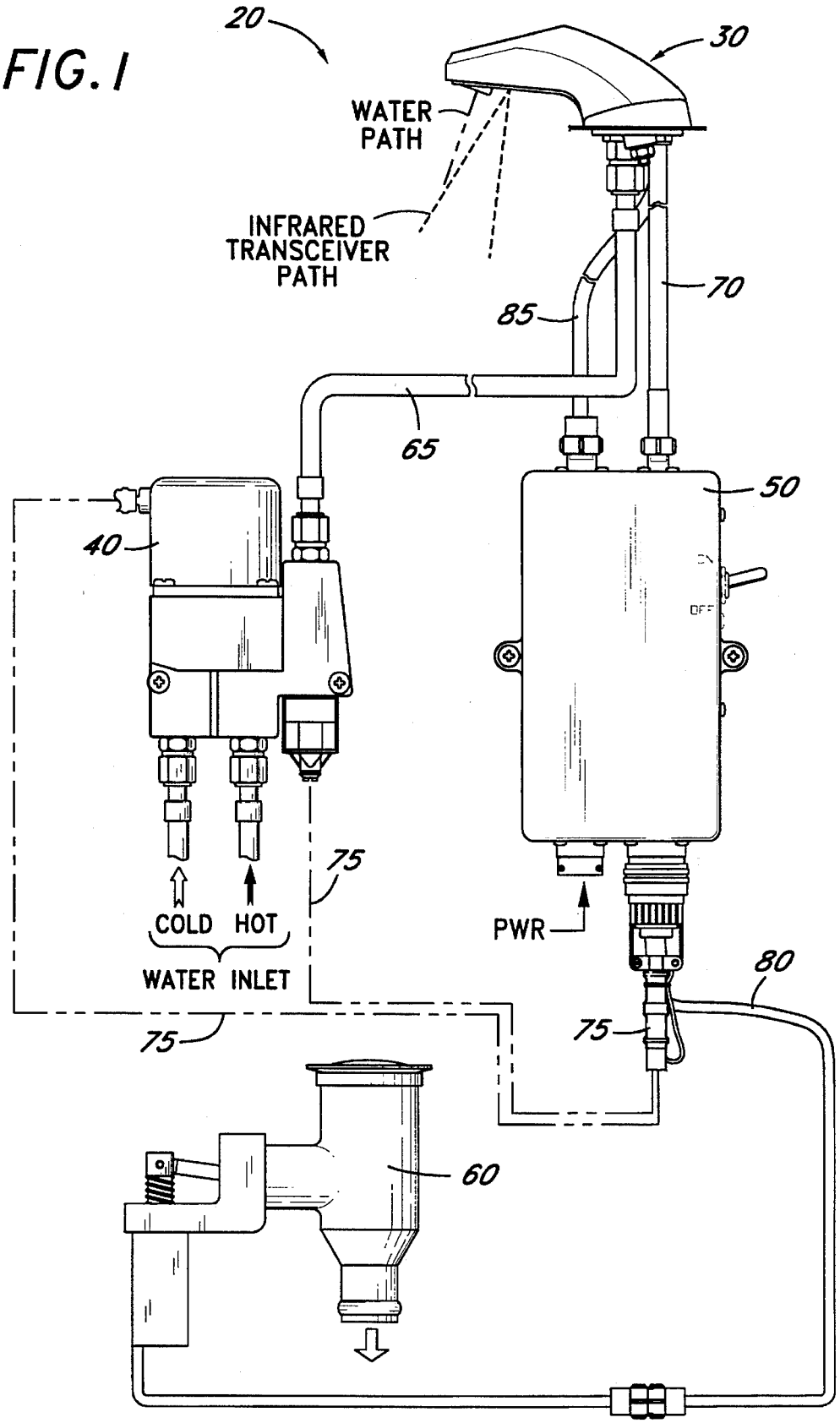
FIG. 1 is a is a block diagram of the preferred embodiment of the variable temperature water supply system.
Figure 2:
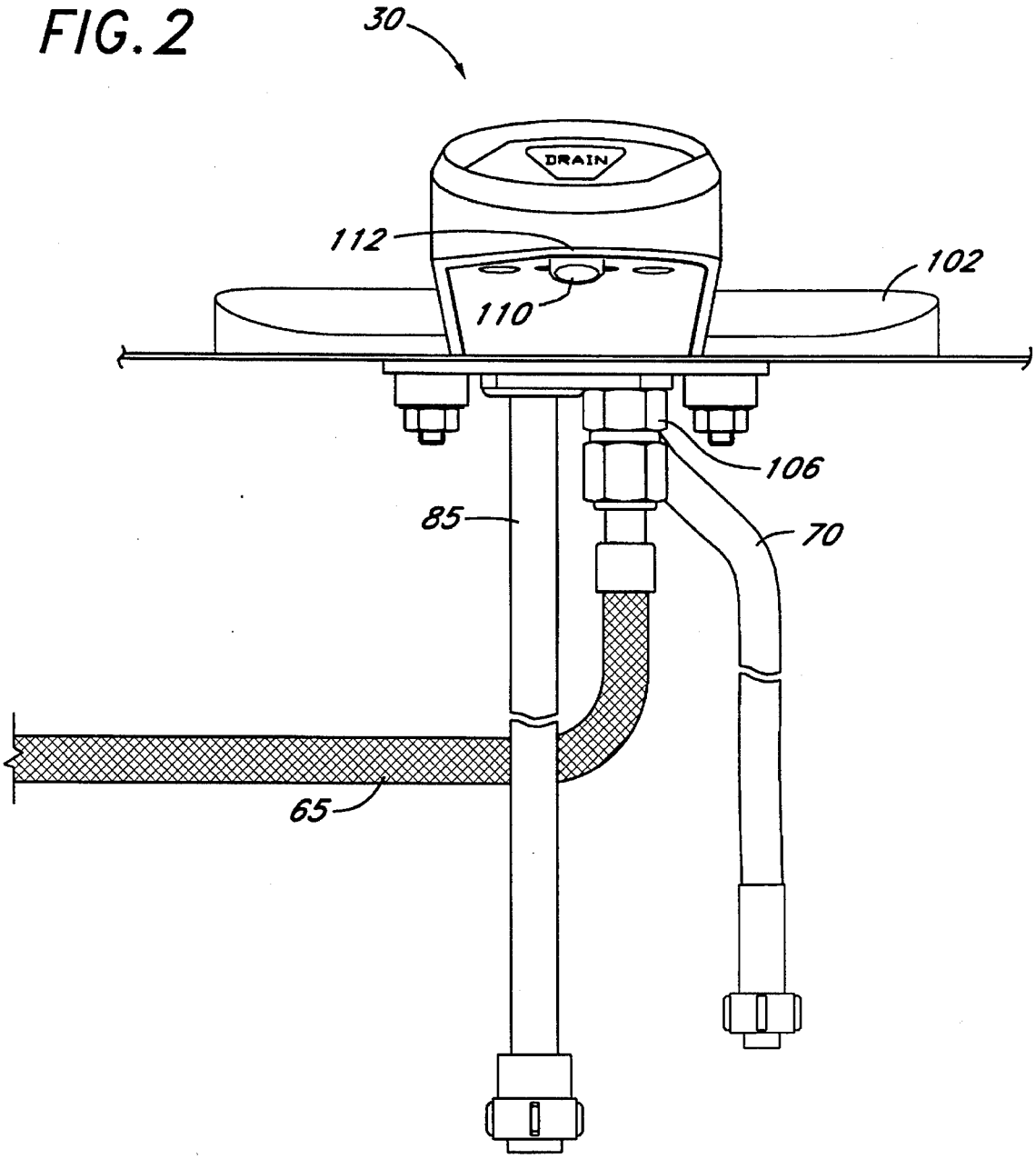
FIG. 2 is a front elevational view of the water faucet assembly of the preferred embodiment.

The variable temperature electronic water supply system 20 of the present invention provides a plurality of preset water temperature settings from which the user may select a desired water temperature to be supplied. As illustrated in FIG. 1, the preferred embodiment of the system comprises a plurality of modularized assemblies. Each of the assemblies are designed to be independently replaceable. The modules that form the system comprise a faucet assembly 30, a hydraulic block 40, an electronic control unit 50, and an electronic drain valve assembly 60. In the preferred embodiment, the faucet assembly 30 is connected to a basin (not shown) which collects the water as it exits the faucet assembly 30. The electronic drain valve assembly 60 is connected to the bottom of the basin and controls the draining and collection of the water in the basin. A flexible hose 65 connects the faucet assembly 30 to the hydraulic block 40 thereby creating a hydraulic passageway. An electrical cable 70 connects the faucet assembly 30 to the electronic control unit 50. An electrical cable 75 connects the electronic control unit 50 to the hydraulic block 40. An electrical cable 80 connects the electronic control unit 50 to the drain assembly 60. An infrared cable 85 connects the faucet assembly 30 to the electronic control unit 50 to deliver photoelectric motion detection signals received from the faucet assembly 30.

As illustrated in FIGS. 2–5, the preferred embodiment of the faucet assembly 30 includes a manifold 128 having a base 102, an interior water passage 104 with an inlet fitting 106 at one end for connection to the hose 65, and an outlet 110 at the opposite end. The faucet has a generally curved neck 116 extending from the base and connected to a generally flat head 122 leading to the outlet 110.

The faucet assembly includes a hollow decorative cover 130 extending over the water manifold 128. The cover 130 is preferably made from a thermoplastic, mineral reinforced resin, which may be chrome, nickel, or brass plated.

A plurality of switches 114 positioned on the faucet cover exterior are accessible for manual operation. The switches 114 are positioned in a flat, circular upper surface 132 of the cover 130. In a preferred embodiment, the switches 114 include an integrated membrane switch keypad 134, which is adhesively bonded to the upper surface 132 of the cover 130. The preferred form of the keypad 134 has five temperature selection switches 114, i.e., a "hot" switch 136, a "mid-hot" switch 138, a "warm" switch 140, a "mid-cold" switch 142 and a "cold" switch 144. The switches 114 are conveniently positioned in a semi-circular array on a forward portion 146 of the faucet upper surface 132. Further, the membrane switch keypad comprises LED indicators 148 which are located next to each temperature selection switch 114. Upon depression of one of the temperature selection switches 114, the LED 148 next to the depressed switch 114 is illuminated. The illumination of the LED 148 indicates the system's acknowledgement of the user's depression of the temperature selection switch 114.

In the preferred embodiment, the membrane switch keypad 134 additionally comprises a drain activation switch 150 which provides electronic activation of the drain valve assembly 60. The drain activation switch 150 is positioned on a rearward portion 152 of the faucet upper surface 132.

Figure 3:
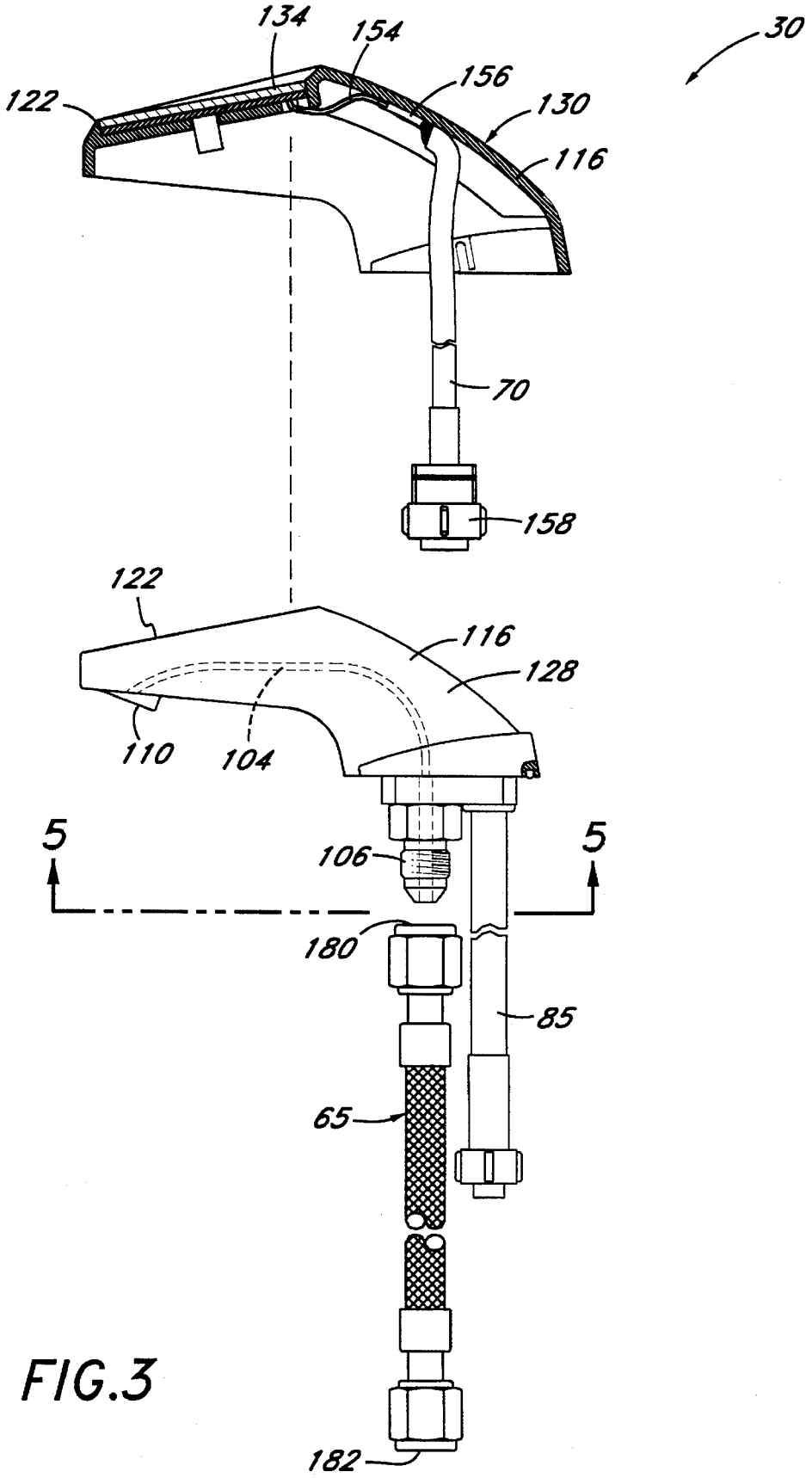
FIG. 3 is an exploded side view of the water faucet assembly illustrating the water manifold and an external decorative cover.
Figure 4:
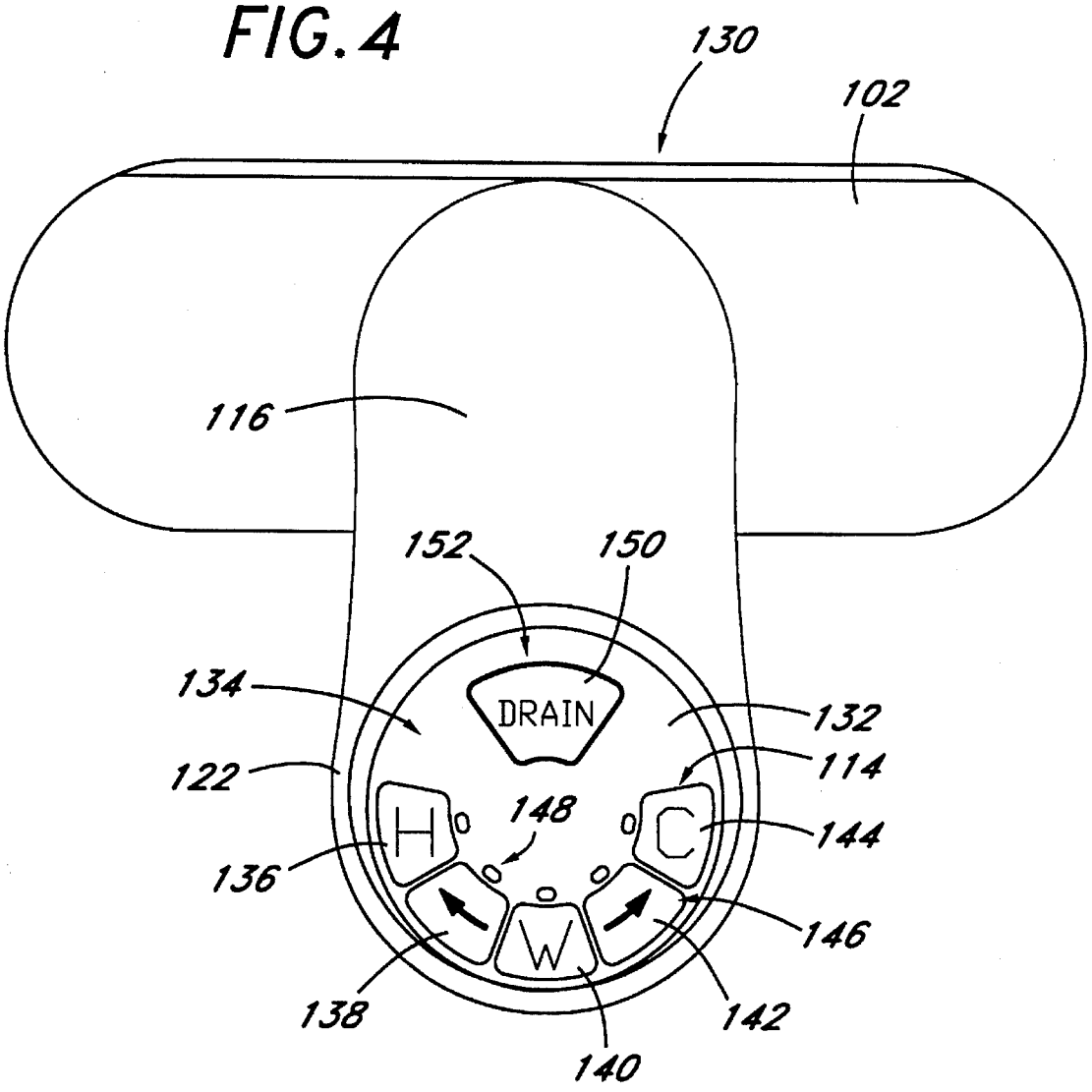
FIG. 4 is a top plan view of the external decorative cover of the faucet assembly.

The switches 114 on the membrane switch keypad 134 comprise a tactile dome having a conductive portion and an open connection portion positioned below the conductive portion of the tactile dome. The specific details are not shown, since they are well known. The membrane switch keypad tactile domes comply with the American Disabilities Act requirements of five pounds maximum operating load. More specifically, the keypad tactile domes require 400 grams maximum load for switch activation. As is well known in the art, when the tactile dome is depressed, the conductive portion of the dome completes the open connection of the switch and enables a signal to be transmitted along the now completed signal line. As illustrated in FIG. 3, the membrane switch keypad 134 is a sealed waterproof unit that is laminated in several layers to a flat cable connector 154 comprising a plurality of electrical connections. Having the keypad sealed is of course important to isolate the electrical connections. The connector 154 is transformed into the electrical cable 70 through a connection transfer device 156. The cable 70 is terminated into a standard circular connector 158 for input into the electronic control unit 50.

Figure 6:
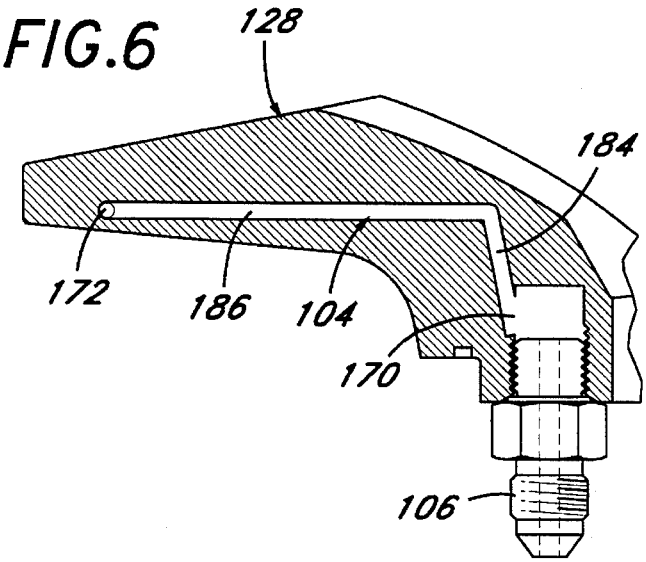
FIG. 6 is a cross-sectional view of the water faucet assembly on the line 6—6 of FIG. 5.
Figure 7:
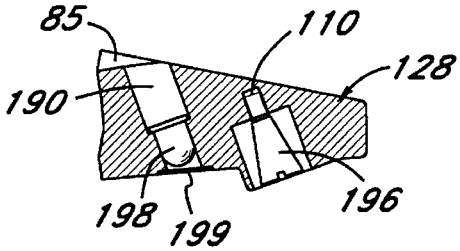
FIG. 7 is a cross-sectional view of the water faucet assembly on the line 7—7 of FIG. 5.
Figure 8:
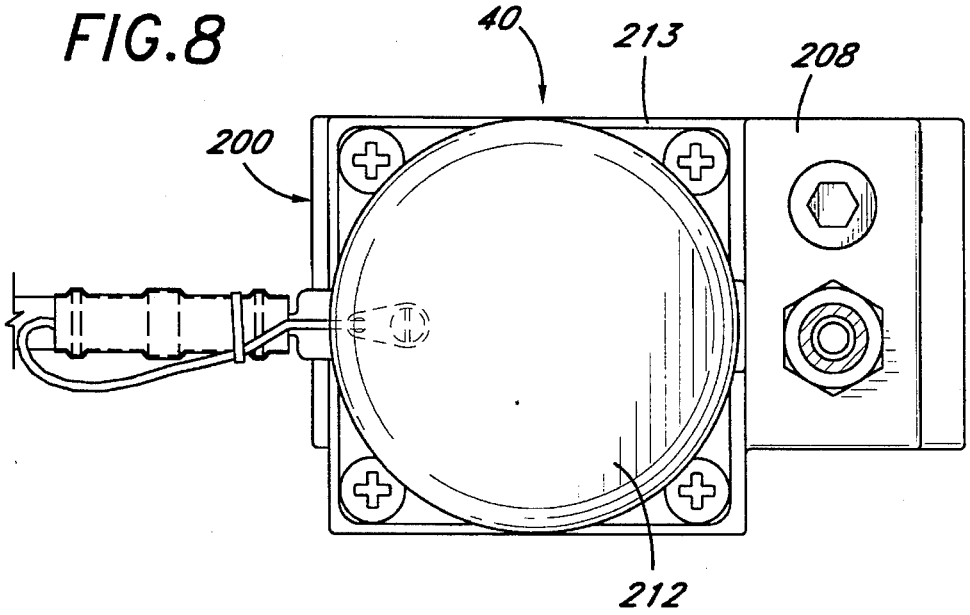
FIG. 8 is a top plan view of the hydraulic block of the system of FIG. 1.
Figure 9:
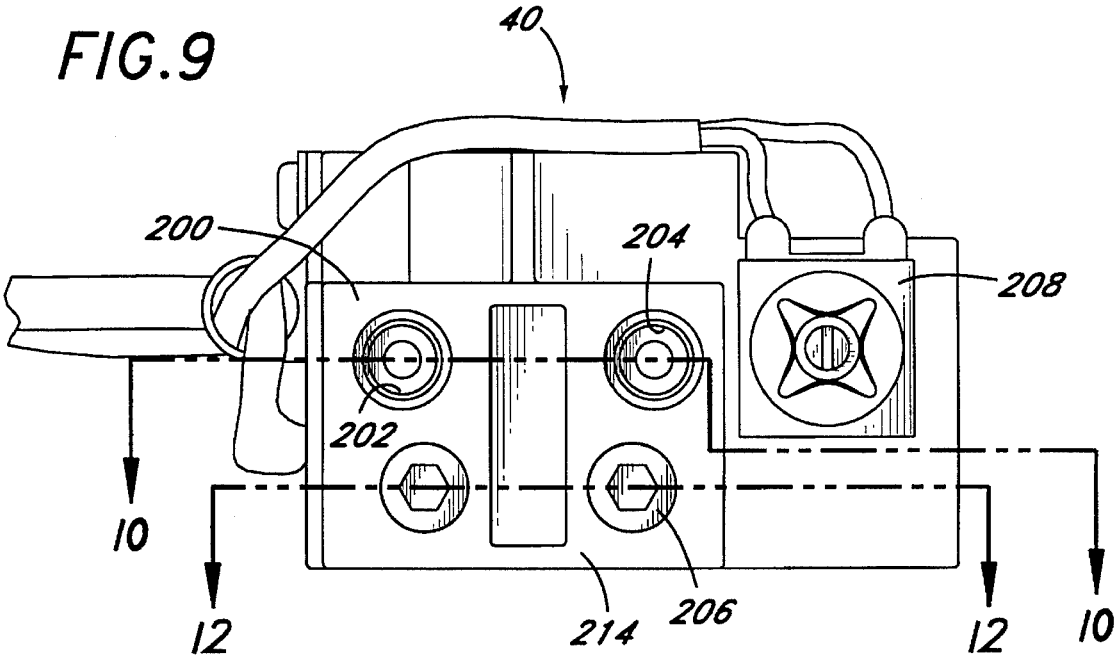
FIG. 9 is a bottom plan view of the hydraulic block.

As illustrated in FIGS. 3 and 6, the water manifold interior water path 104 is somewhat L-shaped, having a short, generally vertical portion 184 and a longer, horizontal portion 186. In the preferred embodiment, the water outlet 110 includes a spigot core 196, as illustrated in FIG. 7. The mounting position of the spigot core 196 determines the path of the water (FIG. 1) as it exits the manifold 128. In the preferred embodiment, the flexible hose 65 that connects the hydraulic block 40 to the faucet assembly 30 is freeze-proof to −165° F. and burst-proof to 200 PSIG. The water manifold 128 is preferably made of a nonreinforced structural polyetherimide (PEI) thermoplastic resin that is plastic injection molded into the desired shape. The manifold has a 15 K PSIG tensile strength and is rated at the capability of supporting a 200 pound compressive load in the assembly application.

Figure 5:
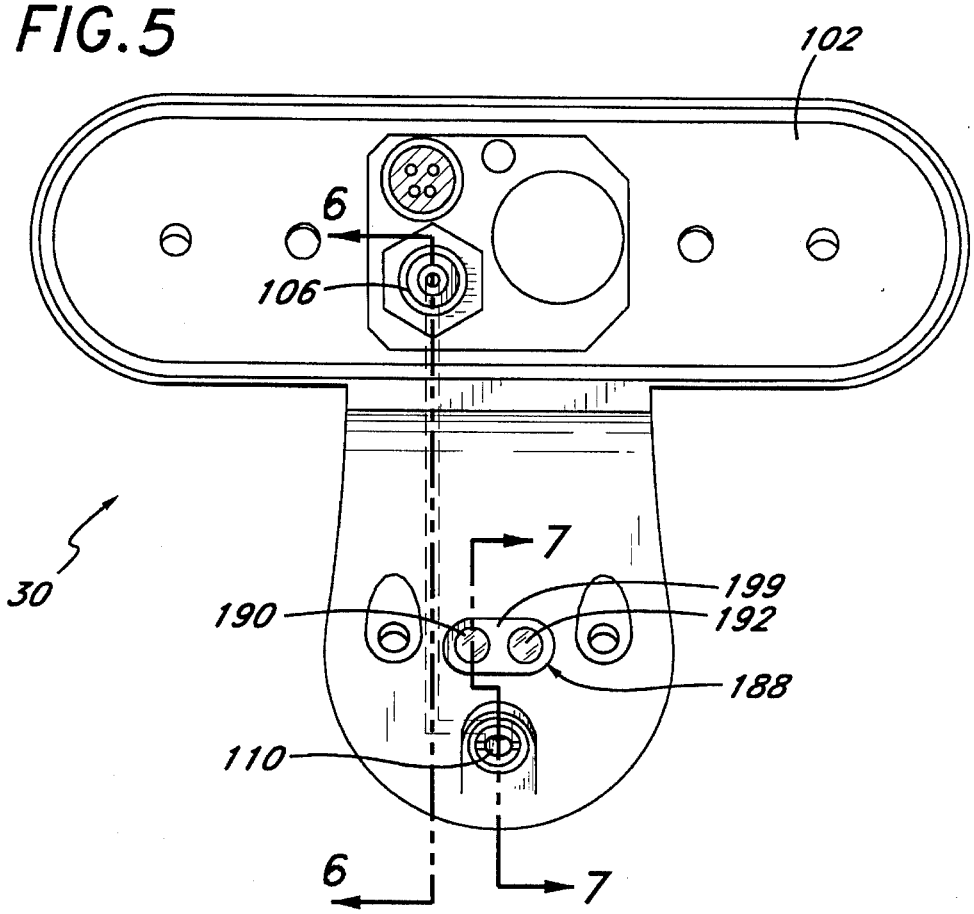
FIG. 5 is a bottom view of the water faucet assembly on line 5—5 of FIG. 3.

An infrared transceiver 188, illustrated in FIGS. 3, 5 and 7, is mounted in the water manifold 128 in order to detect motion within an arcuate detection range (FIG. 1) near the faucet 30. The transceiver 188 comprises a cathode 190 and an emitter 192 that are each photoelectrically connected to the infrared cable 85. The mounting position of the cathode 190 and emitter 192 determine the location of the motion detection range near the faucet 30. In the preferred embodiment, the cathode 190 and emitter 192 are mounted parallel to the spigot core 196. This parallel placement of the cathode 190 and emitter 192 with the spigot core 196 is advantageous, as the infrared transceiver 188 will only sense objects when they are placed directly in an arcuate detection path near the external water path. By limiting the arcuate path within which the transceiver 188 will detect motion, the faucet assembly 30 prevents undesired detection of motion. During installation, one end of the infrared sensor cathode 190 and emitter 192 is potted directly into the water manifold 128, opposite of the cathode 190 and emitter 192, which are covered with a protective lens 199.

The hydraulic block assembly 40, illustrated in FIGS. 8–12, comprises a main body 200, a hot water inlet or conduit 204, a cold water inlet or conduit 202, integrated vent drain valves 206, a solenoid dispensing assembly 208, a rotary mixing valve 210 and a stepper motor 212. The motor is mounted to a top surface 213 of the main body 200. The water inlets 202 and 204 are positioned in a bottom 214 of the main body 200 and open to the rotary mixing valve 210 mounted in a mixing chamber 215.

Figure 10:
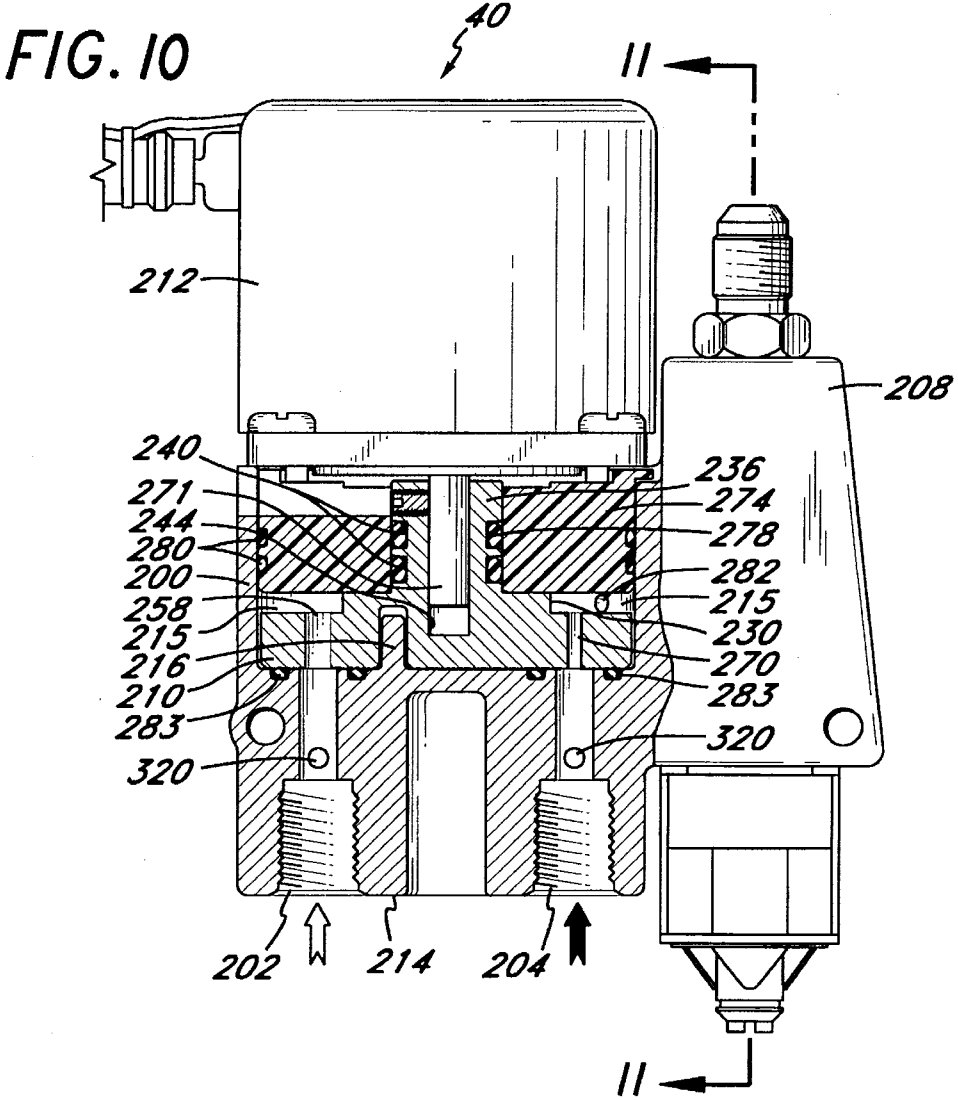
FIG. 10 is a cutaway front elevational view of the hydraulic block on line 10— 10 of FIG. 9.
Figure 13:
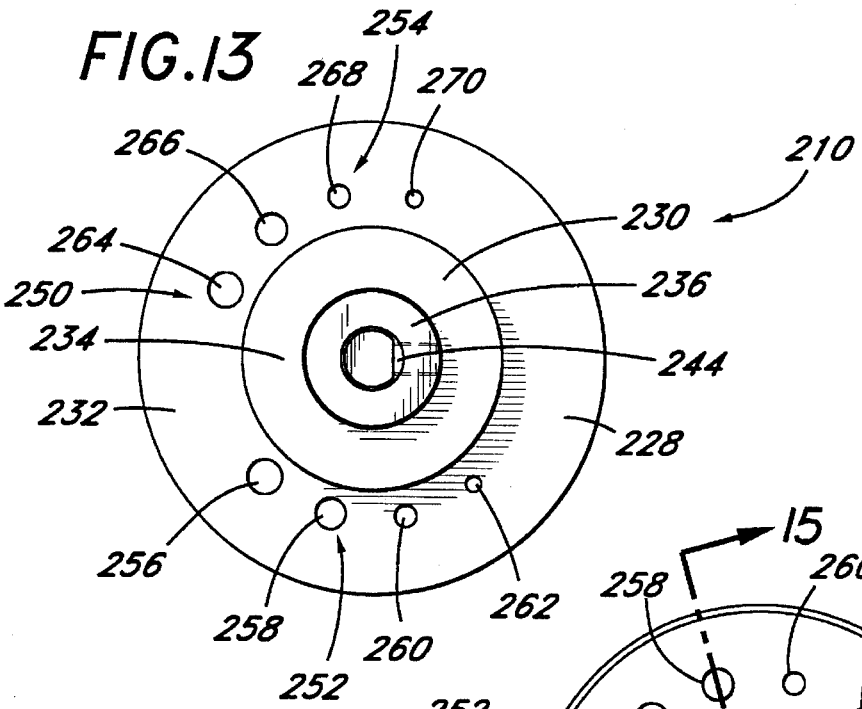
FIG. 13 is a top plan view of the rotary mixing valve.
Figure 14:
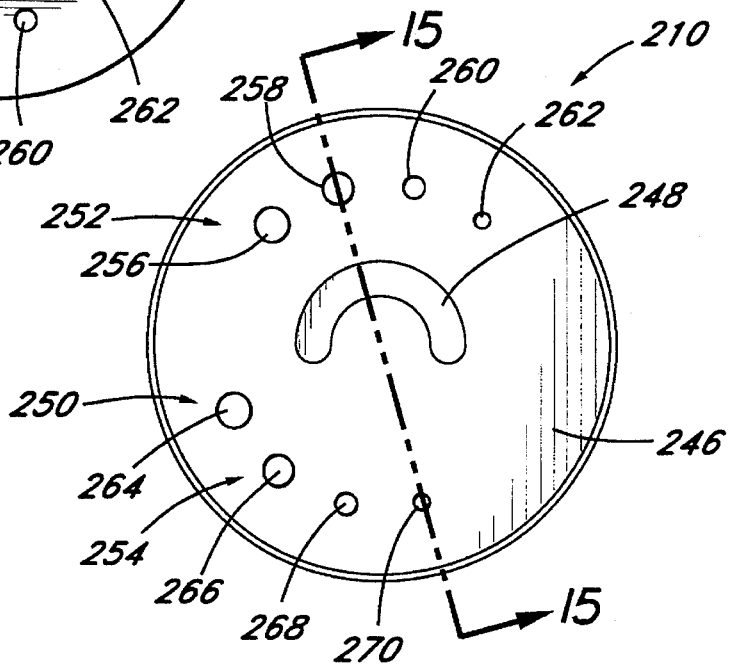
FIG. 14 is a bottom plan view of the rotary mixing valve.
Figure 15:
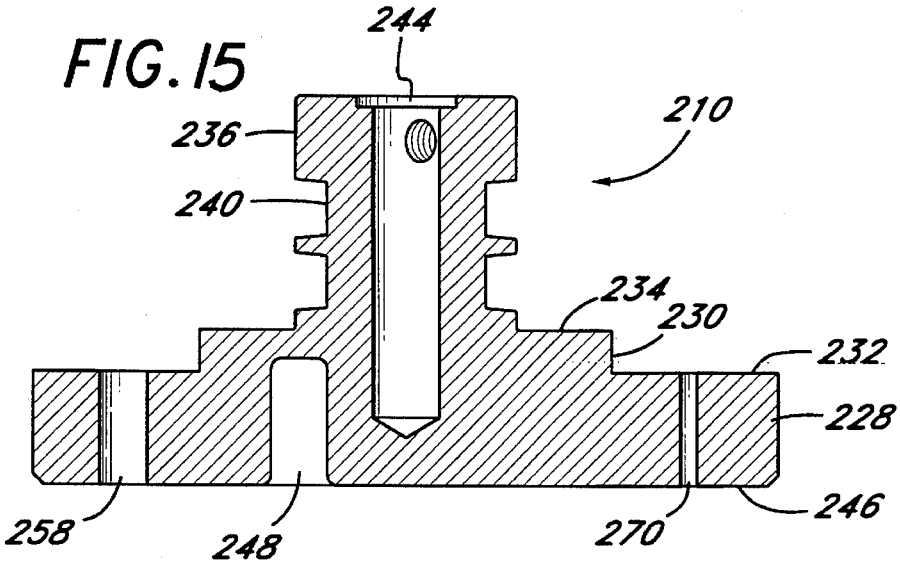
FIG. 15 is a cross-sectional view on line 15—15 of FIG. 14.

As illustrated in FIGS. 13–15, the main portion of the rotary mixing valve 210 is a lower disk 228 having a central annular shoulder 230 extending from a top surface 232 of the disk 228. Extending upwards from a top surface 234 of the shoulder 230 is a cylindrical neck 236. The exterior of the neck 236 has a pair of annular grooves 240 for seating a pair of O-rings 278 (FIG. 10). A central bore 244 extends through the circular neck 236, the annular shoulder 230 and a portion of the way into the disk 228. A bottom surface 246 of the disk 228 includes an arcuate groove 248. A peripheral portion of the disk has a plurality of spaced, axially extending, circular bores of varying diameters positioned in "cold" and "hot" arcuate arrays 252, 254, respectively. The cold array comprises an extra large diameter bore 256, a large diameter bore 258, a medium diameter bore 260, and a small diameter bore 262. The hot array 254 likewise has an extra large diameter bore 264, a large diameter bore 266, a medium diameter bore 268, and a small diameter bore 270. The cold and hot arrays are aligned on the disk 228 such that the extra large diameter bore 256 is not diametrically directly opposite any bore in the hot array 254; the large diameter bore 258 is positioned directly opposite the small diameter bore 270; the medium diameter bore 260 is positioned directly opposite the medium diameter bore 268; the small diameter bore 262 is positioned directly opposite the large diameter bore 266; and the extra large diameter bore 264 is positioned such that it is not directly opposite any bore.

Referring also to FIG. 10, the stepper motor 212 is connected to the rotary mixing valve 210 by a drive shaft 271 with a D-shaped cross section, which fits within the cylindrical bore 244 in the neck 236 of the rotary mixing valve 210. A set screw engages the flat of the shaft cross section to cause the valve to rotate with the shaft. A projection 216 extends upwardly from the body bottom 214 into the groove 248 to guide and limit rotation of the valve 210. The movement of the stepper motor 212 is regulated by motor control signals from the electronic control unit 50. The stepper motor 212 moves in incremental steps of 1.8° to rotate the rotary valve 210 such that the bores in the arrays 252, 254, respectively, align with the hot water conduit 204 and the cold water conduit 202. This alignment controls the outlet water temperature by controlling the ratio of hot and cold water that is mixed in the mixing chamber 215.

The stepper motor 212 is moved between six different positions to achieve the desired water temperature. In a first or home position, the motor 212 positions the valve 210, such that none of the bores in the cold and hot arrays 252, 254 are aligned with the water conduits. In a second position, also referred to as the "cold" position, the rotary valve 210 has no bore from the hot array 254 aligned with the hot water conduit 204, and the extra large diametered bore 256 from the cold array 252 is aligned with the cold water conduit 202. In a third position, also referred to as the "mid-cold" position, the rotary valve small diametered bore 270 is aligned with the hot water conduit 204, and the large diametered bore 258 is aligned with the cold water conduit 202. In a fourth position, referred to as the "warm" position, the medium diametered bore 268 is aligned with the hot water conduit 204, and the medium diametered bore 260 is aligned with the cold water conduit 202. In a fifth position, referred to as the "mid-hot" position, the large diametered bore 268 is aligned with the hot water conduit 204, and the small diametered bore 262 is aligned with the cold water conduit 202. In a sixth position, referred to as the "hot" position, the extra large diametered bore 264 is aligned with the hot water conduit 204, and no bore is aligned with the cold water conduit 202.

In FIG. 10, the rotary valve 210 is in the "mid-cold" position where the large diametered bore 258 from the cold array 252 of bores is aligned with the cold water conduit 202, and the small diametered bore 270 from the hot array 254 is aligned with the hot water conduit 204.

An annular plastic spacer 274 is seated against the top surface of the annular shoulder 230 of the rotary valve 210. An inner wall of the spacer 274 is seated against the cylindrical neck 236 and the O-rings 278. O-rings 280 positioned in grooves on the exterior of the spacer seal the spacer with respect to the body 200. The rotary valve 210 is seated against teflon seals 283 around the upper ends of the water inlets in the main body 200 of the hydraulic block 40. The annular mixing chamber 215 is formed between the spacer 274 and the body bottom 214, with the rotary mixing valve disk 238 and the annular shoulder 230 filling most of the chamber. A passage opens at a first end 282 into the mixing chamber 215 and at a second end 284 into the solenoid dispensing assembly 208, as seen in FIG. 11, forming a path for water to travel from the mixing chamber 215 into the solenoid dispensing assembly 208 for dispensing to the faucet.

Figure 11:
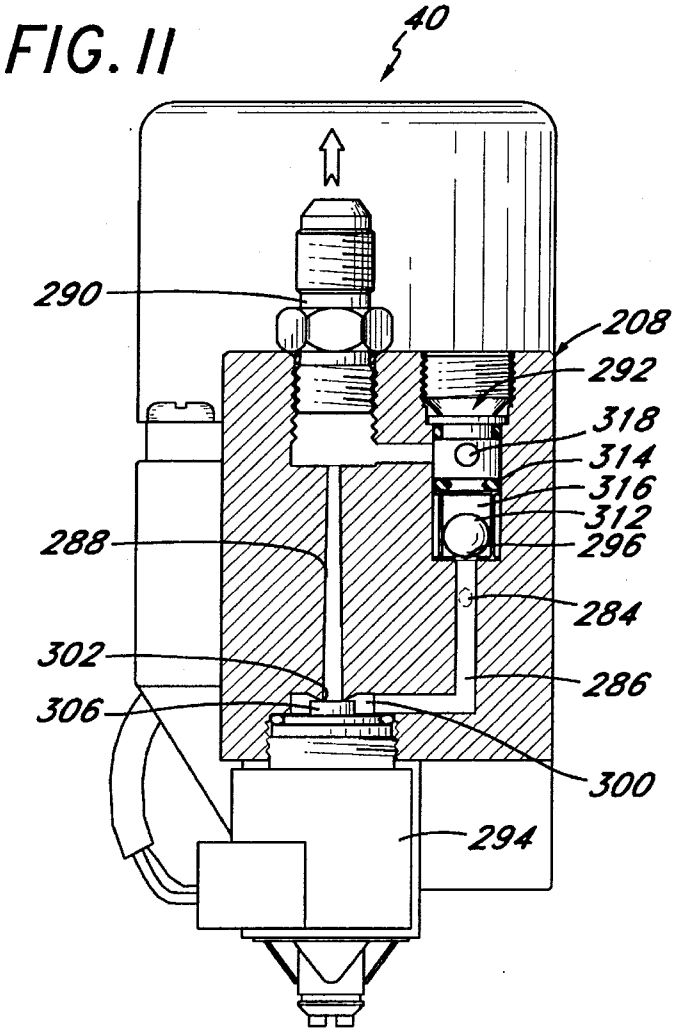
FIG. 11 is a cross-sectional view of the solenoid valve on line 11—11 of FIG. 10.

Referring to FIG. 11, the solenoid dispensing assembly 208 comprises an L-shaped inlet conduit 286, a tapered outlet conduit 288, an outlet fitting 290, a vented drain valve 292, and a solenoid valve 294. The drain valve 292 is connected at one end to the L-shaped inlet conduit 286. The end 284 of the path from the mixing chamber opens into the conduit 286 just below the drain valve 292. The other end of the conduit 286 is connected to the lower end of the outlet conduit 288, which forms a valve seat 302 for a movable valve member 306 of the solenoid valve 294. The outlet conduit 288 is tapered to control the flow of the water that is delivered to the faucet assembly 30. The other end of the tapered conduit 288 is connected to the outlet fitting 290. When the solenoid valve 294 is de-energized, the valve member 306 is closed against the valve seat 302 and blocks the flow of water from the inlet conduit 286 to the outlet conduit 288. When the solenoid valve 294 is energized, the valve member 306 is retracted, allowing the water to flow to the outlet conduit 288 and ultimately to the faucet 30.

Figure 12:
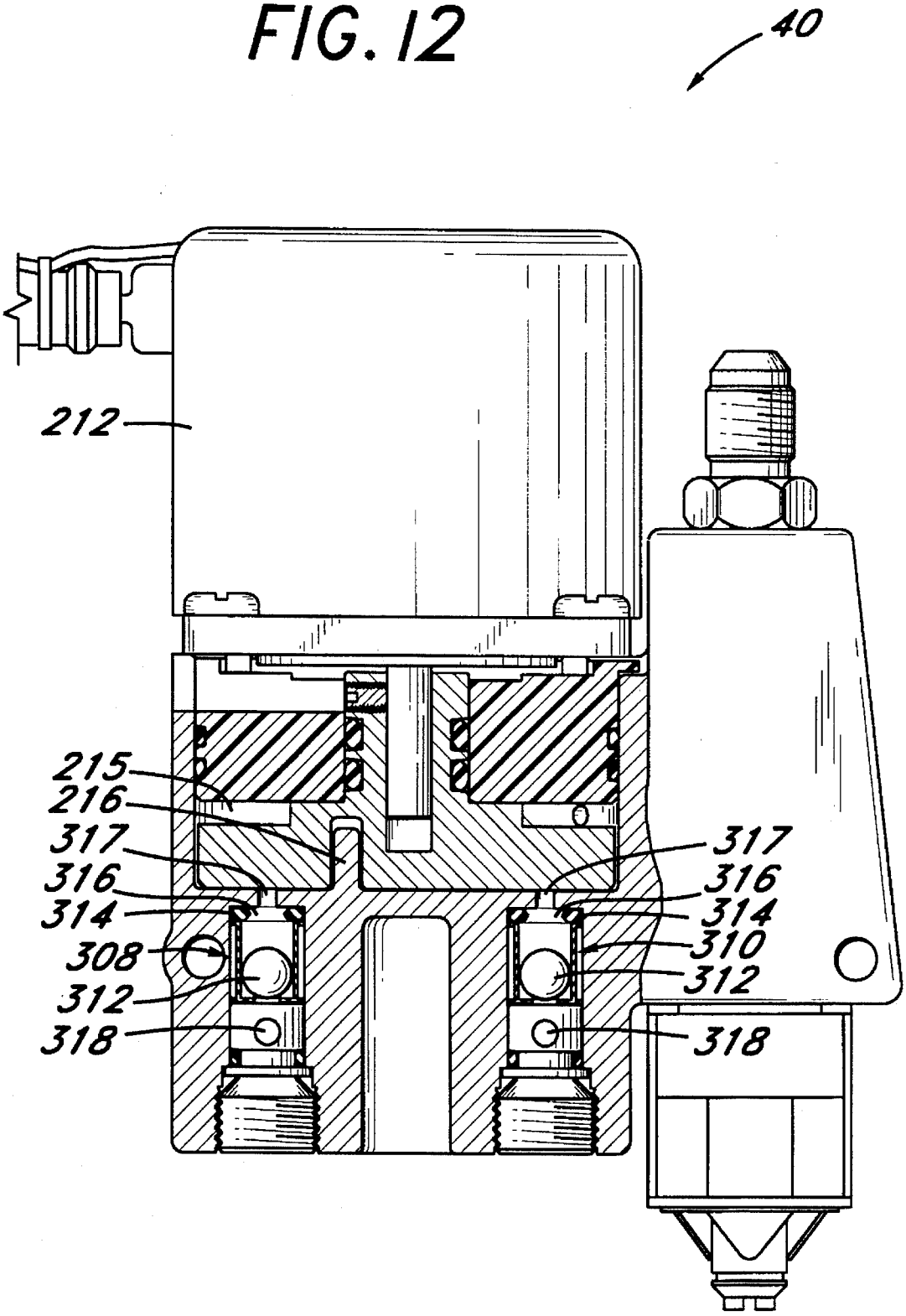
FIG. 12 is a cutaway front elevational view on line 12—12 of FIG. 9.

To prevent a buildup of water in the hydraulic block from freezing and potentially cracking the block when the water supply is depressurized, the excess water in the hydraulic block is vented. As illustrated in FIG. 11, the vented drain valve 292 is located near the outlet fitting 290 in the solenoid dispensing assembly 208. As illustrated in FIG. 12, a cold vented drain valve 308 and hot vented drain valve 310 are respectively located near the cold water inlet 202 and hot water inlet 204 (FIG. 10). When the pressurized water enters the inlets, the input pressure closes the valves 308 and 310, i.e., the input pressure applied through port 320 in FIG. 10 and port 318 FIG. 12 seats a polypropylene ball 312 against an o-ring 314, which closes the drain port 316 and prevents flow through passage 317 into the mixing chamber 215. In the case of the drain valve 292, when water pressure is provided to the solenoid dispensing assembly 208, the polypropylene ball 312 is seated against the O-ring 314 in the vent valve preventing flow through the O-ring to the faucet. When the water supply is de-pressurized, the valves 292, 308, 310 open, i.e., the lack of pressure enables the polypropylene balls 312 to move from their O-ring 314 seats and allow water in the various locations of the hydraulic block 40 to drain from the block. The water from the faucet valve 292 drains through the ports 318 and 316 to the mixing chamber 278 through the passage 284. From the mixing chamber 278, water in the hydraulic block 40 drains through the unsealed passages 317 in the block into the drain valves 308, 310. When the drain valves open, the water drains through the ports 316, through the drain holes 318 in each of the valves 308, 310 into the drain outlets 320 (FIG. 10) in the hot water inlet 202 and cold water inlet 204, respectively. As discussed above, the drainage of the water from the hydraulic block 40 prevents repeated freezing of pressurized water in the hydraulic block 40 which may cause permanent damage to the hydraulic block 40 or the seals, over time. If both water inlet lines are depressurized, a single drain valve would be sufficient. However, two are provided so that if either line remains pressurized and the other is depressurized, one vent valve will be available to drain the mixing chamber.

Figure 16:
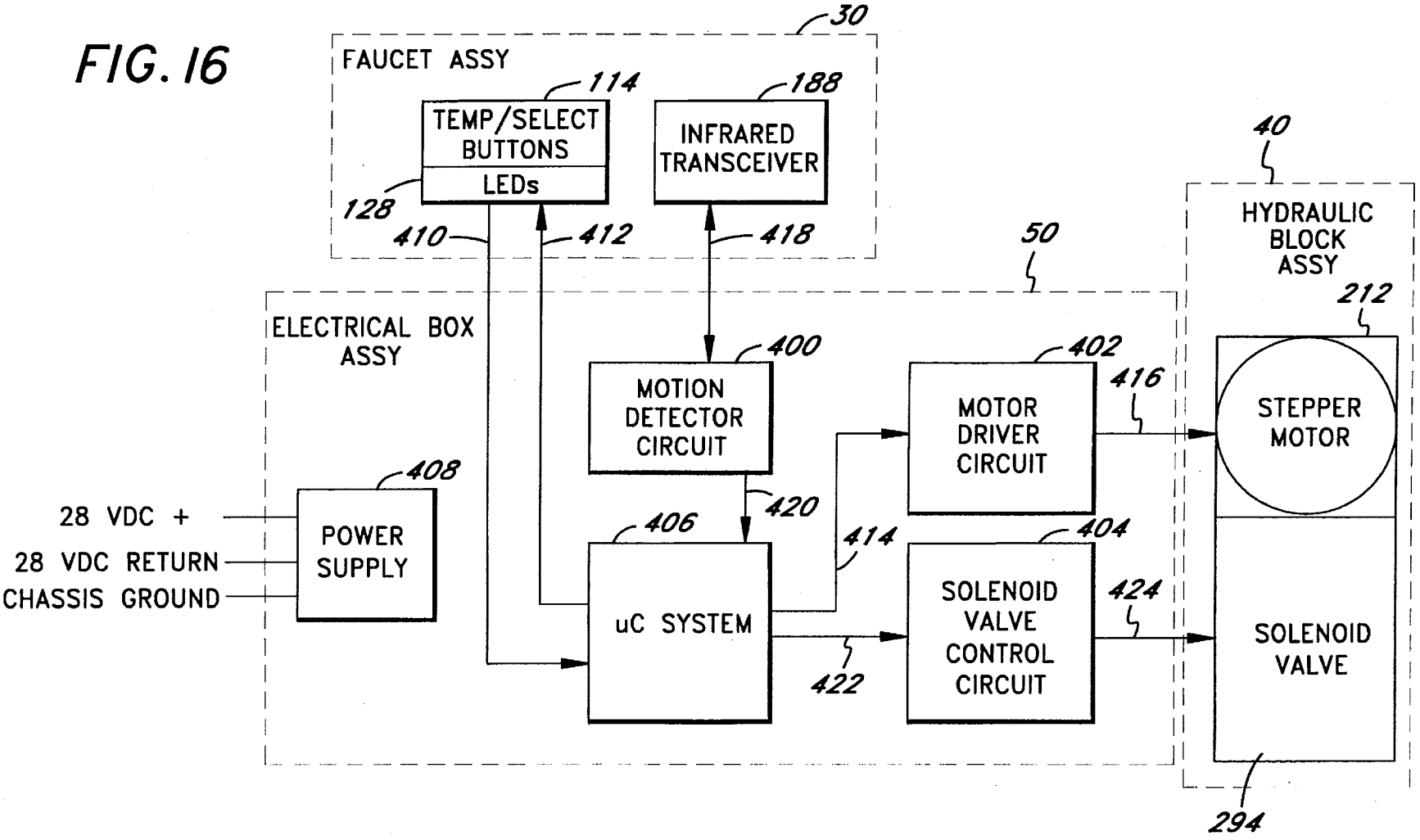
FIG. 16 is a schematic block diagram of the electronic control unit of the variable temperature electronic water supply system.

Referring to FIG. 16, the electronic control unit 50 includes a motion detection circuit 400, a motor driver circuit 402, a solenoid valve control circuit 404, a microcontroller 406 and a power supply 408. A firmware program is resident on an EPROM (not shown) which stores the program for the microcontroller 406. The microcontroller 406 controls the operation of the electronic control unit 50. Preferably, the microcontroller is an Intel 80C31 CMOS microcontroller. Signals to/from the infrared transceiver 188 are transmitted via infrared connector 418 to the motion detector circuit 400. A cyclic infrared signal is output by the infrared transmitter and a reflected portion of this signal is received back through the infrared transceiver. Amplitude variations of the received signal corresponding to those caused by motion, such as hand motion, are detected by the motion detector circuit 400. The motion detector 400 discriminates between the reflected infrared signal caused by motion, such as hand motion, and the background infrared noise. Upon detection of motion, such as hand motion, the motion detector circuit 400 transmits a digital logic level signal on the line 420 to the microcontroller 406. Based upon the conditions of the motion detection signals on the lines 420, the microcontroller 406 sends a solenoid control signal on the line 422 to the solenoid valve control circuit 404. The solenoid valve control circuit 404 when initiated sends a solenoid energization signal 424 to the solenoid valve 294 which enables water to be delivered to the faucet assembly 30. The solenoid valve control circuit 404 when de-initiated removes the solenoid energization signal on the line 424 from the solenoid valve 294.

Signals from the temperature selection switches 114 on the faucet assembly 30 are transmitted on the lines 410 to the microcontroller 406 indicating which temperature selection switch 114 was depressed. Upon receiving the temperature selection signals on the lines 410, the microcontroller 406 also sends a motor driver control signal on the line 414 to the motor driver circuit 402. The motor driver circuit 402 in turn sends motor control signals on the lines 416 to the stepper motor 212 on the hydraulic block 40. The microcontroller 406 also sends a signal on the line 412 to illuminate the appropriate LED 128 near the depressed switch 114 to indicate which switch has been depressed.

Figures 17, 17A, 17B:
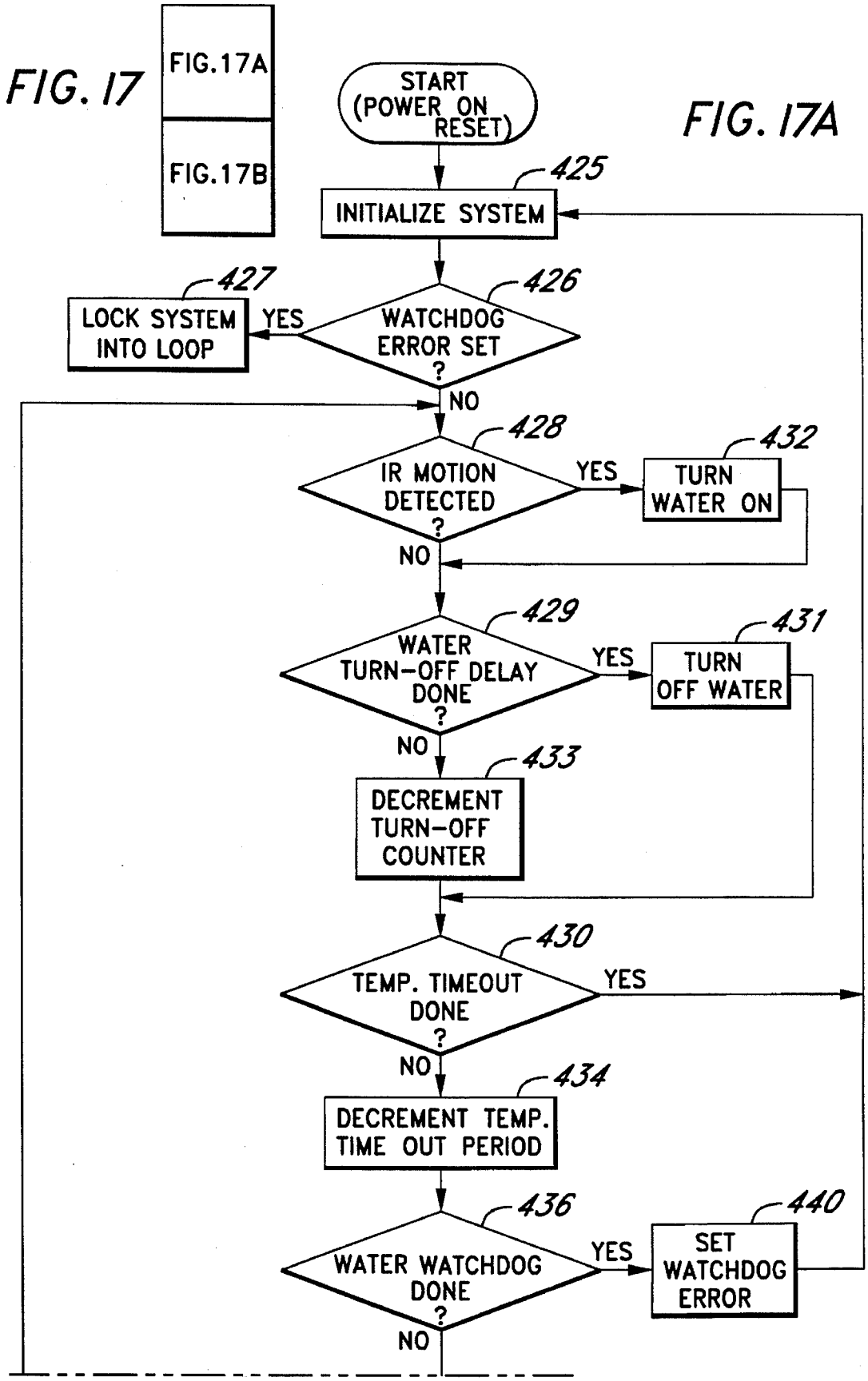
FIG. 17 is a flow chart of the firmware resident in the electronic control unit.
Figure 17B:
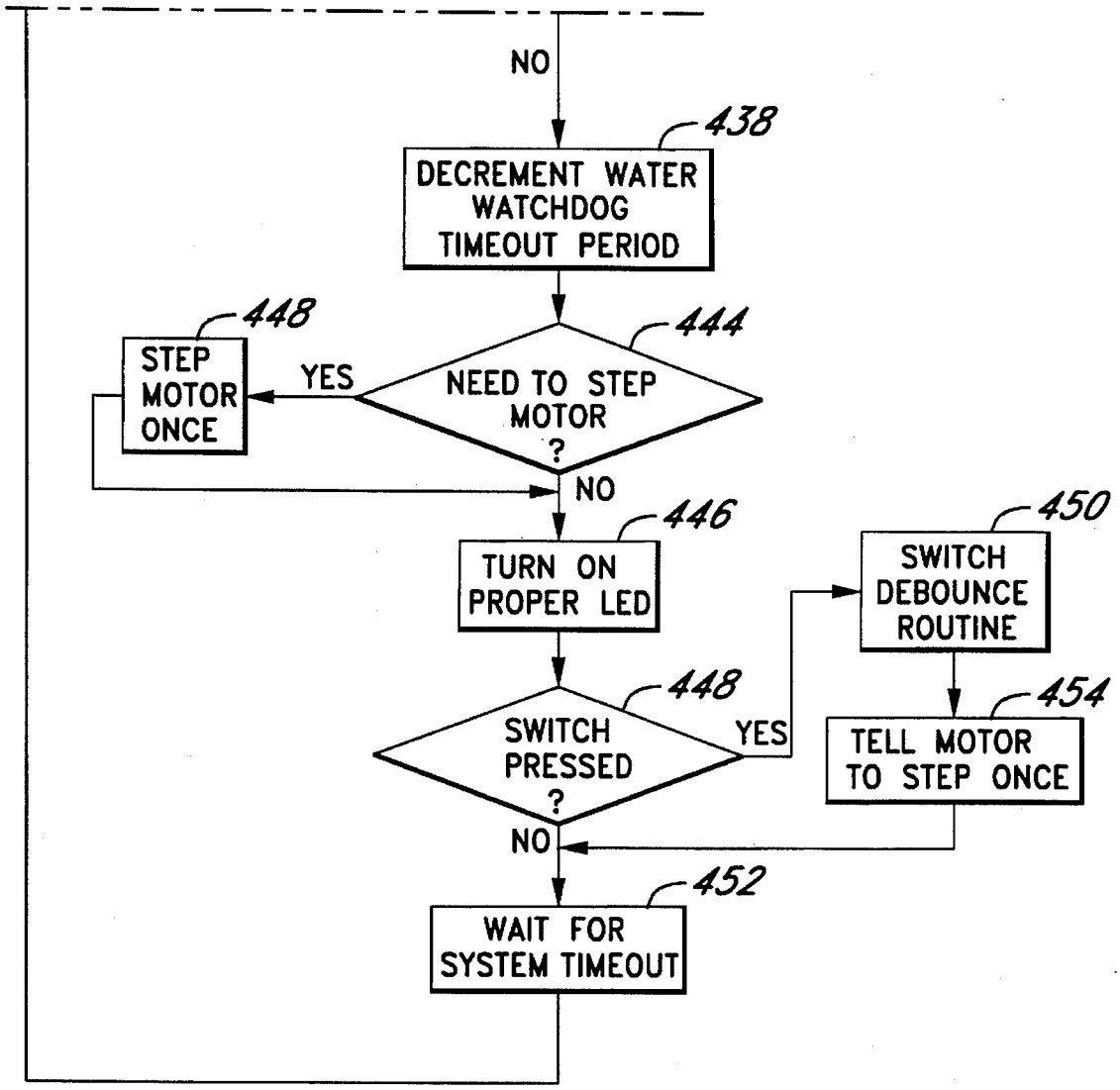

Referring also to the firmware flow chart of FIG. 17, when the variable temperature water supply system is initially turned ON or when the faucet 30 has not been used for a specific time period, a system initialization subroutine is initiated at action block 425 within the microcontroller 406. During the initialization routine at action block 425, the stepper motor 212 is reset to a home position and all counters are reset. At system power up, it is assumed that the motor 212 is currently in the most extreme operating position of the motor 212, which is the sixth position of the rotary valve 210 or the all "hot" position. The motor position is decremented until the motor 212 bottoms against a physical stop which is the home position. In the home position, the rotary valve 210 is positioned such that no hot and cold water are transferred to the mixing chamber. The microcontroller uses the home position as the reference for all motor movement until the system is initialized again. During the initialization routine at action block 425, the microcontroller 206 stores the "warm" temperature default setting as the desired motor position, therefore when the motion detector is activated without one of the temperature selection keypads being depressed, the water supplied to the user will be "warm" and will not scald an unsuspecting user. Control passes to decision block 426.

At decision block 426, a watchdog error flag is checked. If the watchdog error flag is not set, control passes to decision block 428. If the watchdog error flag is set, control passes to action block 427. At action block 427, the firmware is locked into a never ending loop until the system is turned off. The water supply system 20 can be reset through an external on/off switch located near the faucet 30 on the electronics control circuit 50. The entire system must be turned off, then turned on again to reinitiate operation of the system. This "watchdog" feature prevents excessive water waste due to a possible system malfunction.

At decision block 428, the microcontroller 406 checks to see if motion has been detected by the motion detection circuit 400. If motion has not been detected, the firmware program proceeds to decision block 429. If motion has been detected, control passes to action block 432. At action block 432, the microcontroller 406 sends a solenoid control signal 422 to the solenoid control circuit 404. In turn, the solenoid control circuit sends a solenoid energization signal 424 which applies a voltage to the solenoid valve 294 sufficient to energize the solenoid. While the solenoid is energized, water from the hydraulic block assembly 40 is delivered to the faucet assembly 30. From action block 432, control passes to decision block 429.

At decision block 429, the microcontroller checks to see if the turn-off delay time period counter has expired. After the last motion is detected by the infrared transceiver 188 in the faucet assembly 30, a turn-off delay circuit will wait for a predetermined amount of time before it de-energizes the solenoid valve 294. In the preferred embodiment, the predetermined amount of time after motion detection, is two seconds. If the turn-off time period has not expired, control passes to action block 433. At action block 433 the turn-off time period counter is decremented. Control passes to decision block 430. If the turn-off time period has expired, control passes to action block 431. At action block 431, the solenoid valve is de-energized and water from the hydraulic block 40 is prevented from being delivered to the faucet assembly 30. Control then passes to decision block 430.

At decision block 430, the microcontroller 406 checks to see if a temperature time out period has expired. The temperature timeout period keeps track of the amount of time since the last temperature selection switch has been depressed and the last time motion was detected. In the preferred embodiment, the timeout period is thirty seconds. If the temperature timeout period has expired, the firmware program returns to action block 425, where the motor position, temperature selection and counters are reset to their initialized positions. If the temperature timeout period is not completed, control passes to action block 434. At action block 434, the temperature timeout counter is decremented and the firmware proceeds to decision block 436.

At decision block 436, a water "watchdog" timer is checked. The water watchdog timer is used to prevent constant flow of water through the faucet 30 due to a system malfunction. The water watchdog timer monitors the length of time that the solenoid control signal 422 is in a solenoid energization condition. In the preferred embodiment, the water watchdog timeout period for the solenoid energization is three minutes. If, at decision block 436, the water watchdog timer has not expired, control passes to action block 438. If the water watchdog timer has expired control passes to action block 440. At action block 440, a watch dog error is set and control is passed to action block 425.

At action block 438, the watch dog timeout counter is decremented. Control passes to decision block 444. At decision block 444, the microcontroller 406 compares the desired motor position and the current motor position. If the current motor position is equivalent to the desired motor position, the motor does not need to be stepped and the output drivers in the motor driver circuit 402 to the motor 212 are disabled to save power and to minimize circuit heat generation. Control passes to action block 446. If the current motor position is not at the desired motor position, control passes to action block 448. At action block 448, the motor 212 is stepped one increment in the direction towards the desired motor position. Control passes to action block 446.

At action block 446, the microcontroller 406 sends signals to the LEDs 148 to illuminate the LED near the desired temperature selection switch. Control passes to decision block 448. At decision block 448, the microcontroller 406 check to see if a temperature selection switch 114 has been pressed. If a temperature selection switch 114 has been pressed, control passes to action block 450. If a switch has not been pressed, control passes to action block 452.

At action block 450, the microcontroller 406 performs a switch debounce routine which is used to verify that the depression of the switch 114 was intentional. Once the switch press is detected, a switch press counter is set to count the number of system cycles before checking the switch 114 again. In the preferred embodiment, the number of cycles counted corresponds to 20 milliseconds of delay. Once the switch press counter is done counting, the depressed switch is checked again. If the depressed switch is still pressed then a motor step command is set for detection during the next execution of action block 444. The switch press counter is disabled from detecting further switch presses until the switch is released. This prevents multiple switch press detection when the switch is held. Control passes to action block 454.

At action block 454, the microcontroller 406 determines the desired position of the motor 212 to provide the required position of the rotary valve 210 in order to achieve the proper mix of hot and cold water to reach the temperature of the temperature switch 114 that was depressed. The microcontroller 406 compares the desired motor position and the current motor position. If the current motor position is not at the desired motor position, the motor 212 is stepped one increment in the direction towards the desired motor position. As indicated above, if the motor 212 is already at the desired position, output drivers in the motor driver circuit 402 to the motor 212 are disabled to save power and to minimize circuit heat generation. Control passes to action block 452.

At action block 452, the microcontroller 406 waits for the system timer to timeout. Once the system timer times out, the microcontroller 406 returns to decision block 428 and the cycle begins again. In the preferred embodiment, one system cycle corresponds to the minimum time for a single motor step.

Figure 18:
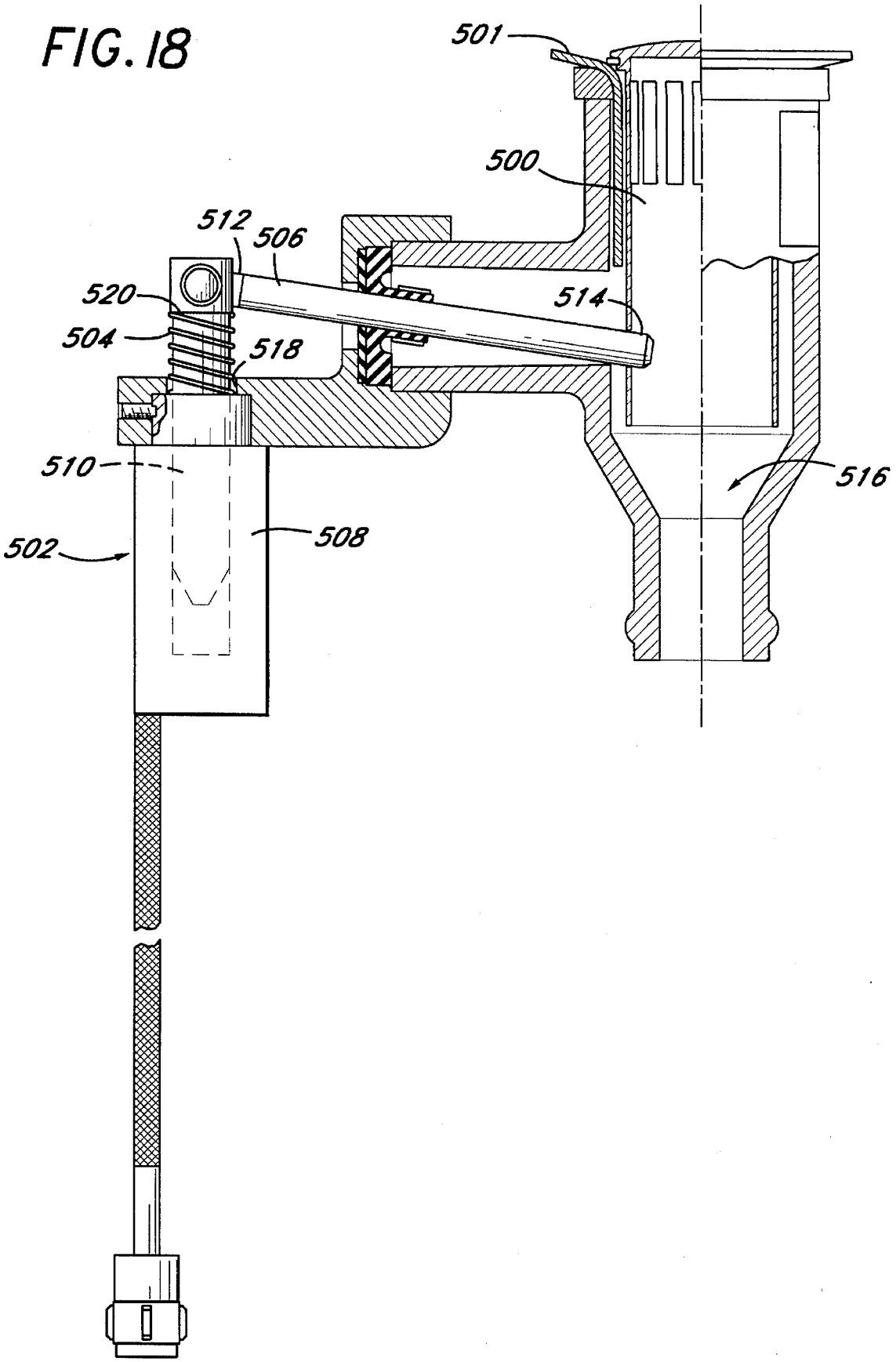
FIG. 18 is a cross-sectional view of the electronic drain valve assembly.

Referring now to FIG. 18, the electronic drain valve assembly 60 comprises a drain valve element 500 seated against the valve seat 501 at the upper end of the drain line 516, a pull solenoid 502, a compression spring 504, and an actuation rod 506. The solenoid comprises an annular solenoid coil 508 and a solenoid shaft 510 positioned in the coil 508. Pivotably connected to the upper end 520 of the shaft 510 is an outer end 512 of the actuation rod 506. The inner end 514 of the rod 506 extends into a side wall of the valve element 500. The spring 504 positioned around the upper end of the solenoid shaft 510 urges it and the rod end 512 upwardly holding the valve 500 closed. When the solenoid 502 is energized, the solenoid force counteracts the compression spring force and pulls the solenoid shaft 510 into the solenoid coil 508. The outer end 512 of the actuation rod 506 is pulled downward by the solenoid force, causing the inner end 514 of the actuation rod 506 to be raised pushing the drain valve 500 upwards, which opens the valve and allows drainage through the drain line 516. When the solenoid 502 is de-energized, the force of the compression spring 504 pushes the solenoid shaft 510 upwards to close the valve 500.

With the modularized design of the variable temperature water supply system 20 each component is independently serviceable and can be replaced at any time, and mixed or matched with another. In this manner, the hydraulic block 40, electronic control unit 50 and the electronic drain assembly 60 are versatile and identical for use with the changing aesthetics of the faucet assembly 30. Basically, the cables or other electronic connection from the electronic control circuit 50 to the module being replaced is disconnected. When the new module is connected, the electronic connection to the electronic control unit 50 is replaced. If the faucet assembly 30 or the hydraulic block 40 is to be replaced, the flexible hose 65 connection from the faucet assembly 30 to the hydraulic block 40 is disconnected. Upon replacement, the flexible hose 65 forming the hydraulic connection between the faucet assembly 30 and the hydraulic block 40 is reinstated. This is advantageous over prior art faucets which require replacement of the entire system in order to change either the aesthetic design or a nonfunctioning module.

In use, the variable temperature electronic water supply system 20 as seen in FIG. 1 provides water on demand at preselected temperatures and allows for electric switch actuation for opening of the drain valve poppet to drain the sink after use. Initially, the user selects a faucet temperature by depressing any one of the temperature selection switches, i.e., "cold," "mid-cold," "warm," "mid-hot," and "hot." As described above, depression of the keypad for temperature selection sends an electrical output signal along electrical connectors to an electronic control circuit. The electronics control circuit in turn sends a signal to an LED indicator which will light next to the selected temperature keypad position that was depressed by the user. In addition, the electronic circuit sends a signal to the stepper motor in the hydraulic block which positions the rotary valve to the precise location for the selected water temperature.

Motion beneath the faucet and within the detection zone of the infrared indicators causes the infrared transceivers to send a photoelectrical output signal along photoelectric connectors to a motion detection circuit in the electronics control circuitry. The motion detection circuit translates the photoelectric signals to a digital signal which indicates the detection of motion within the infrared detection zone which in turn sends an electrical output signal to the electronic control circuit. The electronic control circuit sends an electrical energization signal to the solenoid in the hydraulic block. Upon energization of the solenoid, a water path is enabled in the hydraulic block allowing water to pass from the mixing valve chamber to an outlet port and to the flexible hose. From the flexible hose, the water is directed to the faucet assembly and its outlet.

As long as motion is detected in the range of the infrared transceivers, water will be supplied to the faucet. Within two seconds of the motion detector sensing no motion in front of it, the solenoid valve will close halting water flow. The temperature selection switch will return to the default setting, i.e., the "warm" setting, after 30 seconds of nonuse of the motion detector. Further, after 30 seconds of nonmotion the rotary valve and stepper motor will automatically move to the initialization, or home position which seals off any water mixing in the valve mixing chamber. When the motion detector is reactivated without one of the temperature selection keypads being depressed, the microcontroller stores the "warm" default setting and drives the position of the mixing valve to the default "warm" location. The default temperature is provided to prevent unintentional scalding of the user in the event that the last temperature selected was in the "hot" position and the new user did not pay attention to the temperature selection.

When the variable temperature water faucet water supply system is installed in an aircraft, the drain valve poppet is normally in a closed position to block the drain as seen in FIG. 18. As the sink bowl (not shown) fills with water, the passenger can activate the drain poppet to open and drain the sink bowl by depressing the membrane switch keypad on the top surface of the faucet marked "drain." By depressing the "drain" keypad switch, an electrical signal is sent to the electronics circuit indicating that the drain keypad has been activated. The electronic circuit sends an electrical output signal to a pull solenoid that is attached to the drain actuation rod. The energization of the solenoid opens the drain valve. The sink can now drain for as long as the user depresses the keypad. Once the user releases the "drain" keypad, the solenoid is de-energized which causes the drain valve to close.

Advantageously, the faucet of the present invention complies with the standards outlined in the Disabled Persons Act. By removing the knobs, plungers, etc. which are commonly used in restroom faucets for water temperature selection, drain activation and faucet activation and replacing them with a membrane switch keypad and a motion detector to perform these functions, the faucet water supply system of the present invention is convenient for all people to use, disabled or not. Further, the ability to select the desired water temperature as well as initiating the operation of the faucet via motion detection near the facet head is clearly advantageous over the previous proximity sensing faucets which did not include the temperature selection feature of the present invention. Lastly, the removal of all unneeded knobs, buttons, plungers, etc., that are commonly used to operate a faucet provides the advantageous adaptation of the faucet of the present invention to airline restrooms by minimizing the amount of space the faucet head requires. By providing all of the temperature selection features and drain activation on the faucet head, the faucet water supply system of the present invention provides the total functionality of a conventional faucet while reducing the amount of space required by the faucet.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A variable temperature water control system for automatically delivering a user-selected mixture of a hot water supply and a cold water supply comprising:

a mixing chamber having a hot water inlet and a cold water inlet;

a rotary valve positioned in the chamber, the valve including a disk portion having a plurality of various sized openings, which are selectively alignable with the water inlets upon rotation of the rotary valve to thereby control the proportion of hot and cold water introduced to the mixing chamber;

a stepper motor connected to control the rotation of the rotary valve;

a solenoid valve capable of controlling the flow of water from the mixing chamber;

a motion detector capable of generating a motion detection signal indicating that motion is occurring near the water control system; and a microcontroller connected to a water temperature selector to receive a desired water temperature signal, the microcontroller being capable of generating an output signal, which is delivered to the motor to control the desired rotational position of the valve to achieve the desired water temperature, the microcontroller additionally being connected to the motion detector and being capable of generating a signal to open the solenoid valve when motion is detected near the water control system.

2. The system of claim 1, including a faucet having mounted thereon said water temperature selector and said motion detector.

3. The system of claim 2, wherein said water temperature selector includes a plurality of membrane switches which are preset to provide a plurality of selected temperature settings.

4. The system of claim 3, wherein the faucet has an upper surface and the switches are positioned in said upper surface.

* * * * *